US006789726B2

(12) United States Patent
Keefe, Jr. et al.

(10) Patent No.: US 6,789,726 B2
(45) Date of Patent: Sep. 14, 2004

(54) MULTI-PURPOSE PACKING, SHIPPING AND DISPLAY CONTAINER

(75) Inventors: Walter D. Keefe, Jr., Carol Stream, IL (US); Nicholas A. Philips, Sugar Grove, IL (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/233,229

(22) Filed: Aug. 30, 2002

(65) Prior Publication Data

US 2003/0085264 A1 May 8, 2003

Related U.S. Application Data

(60) Provisional application No. 60/316,329, filed on Aug. 30, 2001.

(51) Int. Cl.[7] ..... B65D 120/011

(52) U.S. Cl. ..... 229/120.011; 229/120.38; 229/125.01

(58) Field of Search ..... 229/120.011, 125.07, 229/117.16, 120.29, 120.33, 120.38

(56) References Cited

U.S. PATENT DOCUMENTS

| | | | | | |
|---|---|---|---|---|---|
| 2,791,362 | A | * | 5/1957 | Nute | 229/120.11 |
| 3,092,301 | A | * | 6/1963 | Selle | 229/120.11 |
| 3,253,765 | A | * | 5/1966 | Train | 229/120.11 |
| 3,392,904 | A | * | 7/1968 | Wei | 229/120.11 |
| 3,677,458 | A | | 7/1972 | Gosling | |
| 4,256,223 | A | | 3/1981 | Pawlowski | |
| 4,377,237 | A | | 3/1983 | Pawlowski | |
| 4,533,052 | A | | 8/1985 | Fruchey et al. | |
| 4,793,494 | A | | 12/1988 | Gordon, Jr. | |
| 4,826,016 | A | | 5/1989 | Foster | |
| 4,909,433 | A | * | 3/1990 | Taylor | 229/120.11 |
| 6,244,502 | B1 | * | 6/2001 | Hollar et al. | 229/120.11 |

* cited by examiner

*Primary Examiner*—Tri M. Mai

(57) ABSTRACT

The present invention includes a unique multi-purpose blank and resulting container for packing, shipping and displaying a product at a point-of-purchase. The container includes two substantially similar display units hingedly connected to one another along a detachable hinge line. The container holds products in a horizontal or vertical orientation. Additionally, the first display unit may be separated from the second display unit along the hinge line. Consequently, the display units may also be placed side-by-side, stacked vertically, or displayed singularly. A removable H-divider separates the first display unit from the second display unit and provides additional structural support. Additionally, an optional closure panel may be included to cover the display units.

11 Claims, 7 Drawing Sheets

MULTI-PURPOSE PACKING, SHIPPING AND DISPLAY CONTAINER

RELATED APPLICATIONS

This application claims priority to U.S. Provisional Application No. 60/316,329 filed Aug. 30, 2001, the benefit of which is hereby claimed under 35 U.S.C. 119(e).

FIELD OF INVENTION

The present invention relates to containers, and more particularly to shipping and point of sale display containers.

BACKGROUND OF THE INVENTION

Containerboard and paperboard containers are created for a great variety of purposes. For example, containers are used for storing, packaging, shipping and displaying products of practically any nature. Generally, a container is chosen to satisfy only a single particular need such as crushing strength for a shipping container or ornamental value for a display container, but not both.

SUMMARY OF THE INVENTION

The present invention is a blank and container that may be used for packaging, shipping and displaying products. The container may be used as a single unit or may be separated into two substantially identical display units. A removable H-divider is disposed within the container to separate the single container into two separate display units and to provide additional structural support. Like the container, the H-divider is separable, wherein individual sections of the H-divider remain with each display unit to provide structural or other support to each display unit. Additionally, a closure panel may be inserted as a top closure for the container.

At the point of use the container can be displayed in a variety of ways. The container may be displayed vertically, horizontally or folded along the detachable hinge line to display the display units in a back-to-back relationship. Additionally, the container may be separated along the detachable hinge line wherein the display units may be used in a side-by-side, stacked or individual configuration.

DETAILED DESCRIPTION OF THE PREFERRED EMBODIMENTS

The present invention provides a multi-purpose container for packaging, shipping and point-of purchase displaying of any variety of goods. By way of overview and with reference to FIGS. 1 & 4, one presently preferred embodiment of the present invention includes a single piece blank 2 of containerboard material arranged to form a container 40.

Figure 1:
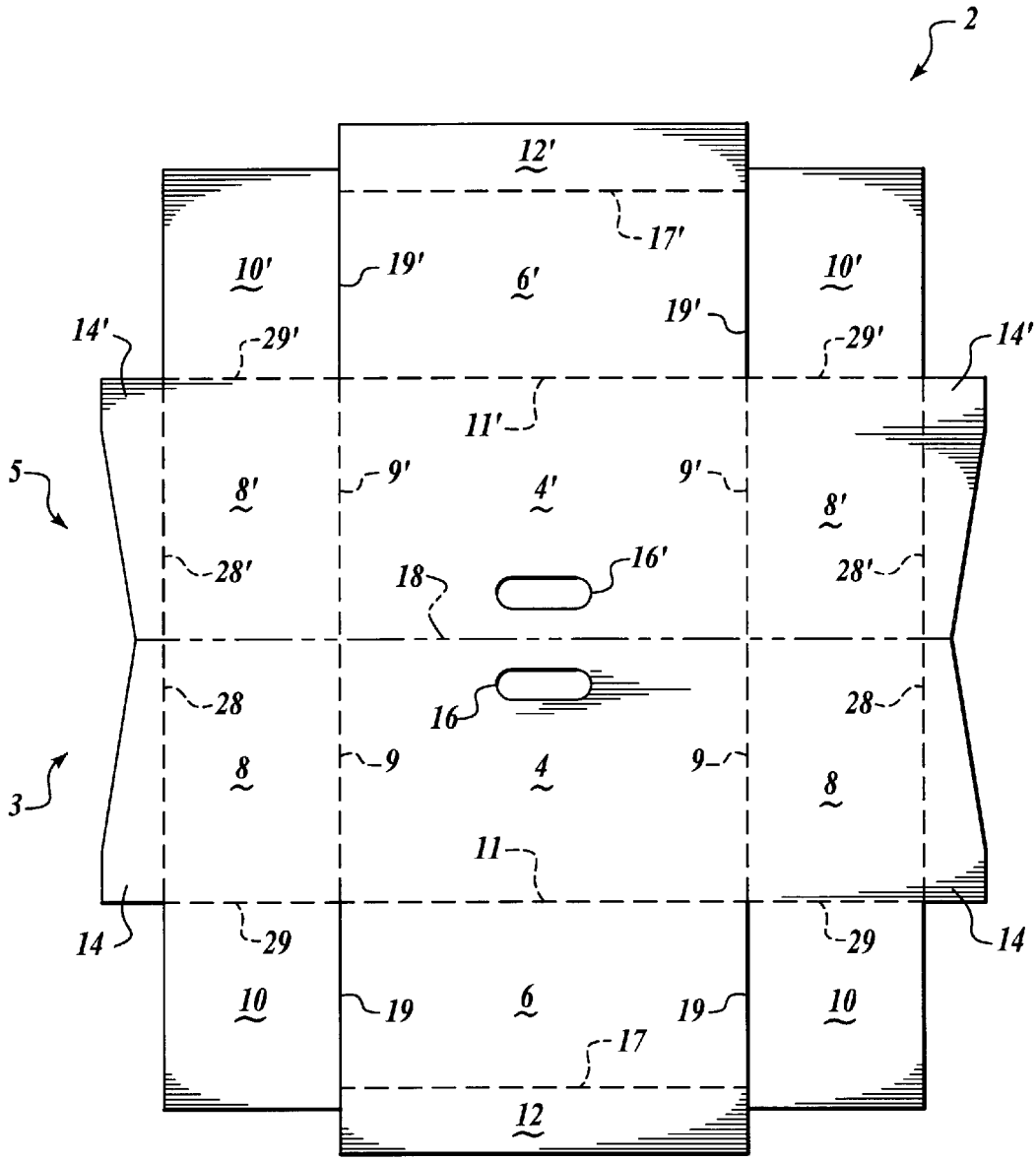
FIG. 1 is a plan view of a single piece container blank formed in accordance with the present invention.

FIG. 1 depicts the blank 2 used to form the container 40. The blank 2 is preferably constructed from a single piece of formable material, such as, without limitation, containerboard or paperboard. The blank 2 is cut, scored, perforated or otherwise formed to include a plurality of panels which, when assembled, create the container 40 of the present invention.

The blank 2 and subsequent container 40 include a first display unit 3 and a second display unit 5 which are substantially symmetric about a detachable hinge line 18. The display units 3, 5 each include a bottom panel 4, 4' having side panels 8, 8' and side flaps 14, 14' and an end panel 6, 6' having end flaps 10, 10' and an upper flap 12, 12'.

An H-divider 20 is disposed within the container 40. A closure panel 30 may be used to cover the container 40. The container 40 may be left as a single unit or may be easily separated along the detachable hinge line 18 into two individual display units 3, 5. Consequently, the container 40 may be packed, shipped or displayed in a variety of fashions. Specific details of the blank 2 and the container 40 are described in more detail below.

As discussed above, the blank 2 includes two substantially similar first and second display units 3, 5. As will be appreciated, due to the symmetric nature of the present invention, any discussion regarding one of the display units applies equally to the other. Wherever possible the same number is used in both the first and second display units 3,5. More specifically, in all FIGURES, like numbers indicate like parts. Additionally, cuts are shown as solid lines, score lines as dashed lines and lines of perforations as broken lines.

The first and second display units 3, 5 include bottom panels 4, 4'. The bottom panels 4, 4' are generally rectangular in shape and are hingedly connected to one another along the detachable hinge line 18. Opposite the detachable hinge line 18, the bottom panels 4, 4' are each hingedly connected to end panels 6, 6' along hinge line 11, 11', respectively. The bottom panels 4, 4' are also hingedly connected to substantially identical side panels 8, 8' along hinge lines 9, and 9'. Additionally, optional handholds 16, 16' may be included in the bottom panel 4, 4'. Preferably, the handholds 16, 16' are spaced equidistant from the detachable hinge line 18.

The end panels 6, 6' are rectangular in shape. Preferably, the end panels 6, 6' are slightly narrower in width than bottom panels 4, 4'. The end panels 6, 6' are also hingedly connected to the upper flaps 12, 12' along a hinge line 17, and 17'. Additionally, as shown by cut lines 19, 19, opposed side flaps 10, 10' are adjacent but not connected to the remaining two sides of end panels 6, 6'.

The upper flaps 12, 12' are also rectangular in shape having a longitudinal side length equal to the longitudinal length of the bottom panels 4, 4' and the end panels 6, 6'. However, the width of the upper flaps 12, 12' are narrower than the end panels 6, 6'. The upper flaps 12, 12' are only connected along a single side, the remaining three sides are free. More specifically, as discussed above, the upper flaps 12, 12' are hingedly connected to the end panels 6, 6' along the hinge lines 17, 17'.

Substantially rectangular shaped side panels 8, 8' are hingedly connected to the bottom panels 4, 4' along hinge lines 9 and 9', respectively. Opposite the sides adjacent the bottom panels 4, 4', the side panels 8, 8' are hingedly connected to side flaps 14, 14' along hinge lines 28, 28'. Also, side panels 8, 8' are hingedly attached to side flaps 10, 10' along hinge lines 29 and 29', respectively.

Side flaps 14, 14' are only connected to the side panels 8 and 8', respectively. The side flaps 14, 14' are generally shaped as a rectangle with a beveled corner, wherein the bevel is tapered in a direction toward the detachable hinge line 18.

Side flaps 10, 10' are generally rectangular in shape. As discussed above, the side flaps 10, 10' are hingedly connected only to side panels 8, 8' along hinge lines 29 and 29'. The remaining three sides of the side flaps 10, 10' are free. As best seen in FIG. 1, the side flaps 10, 10' are slightly wider than end panels 6, 6'.

Figure 2:
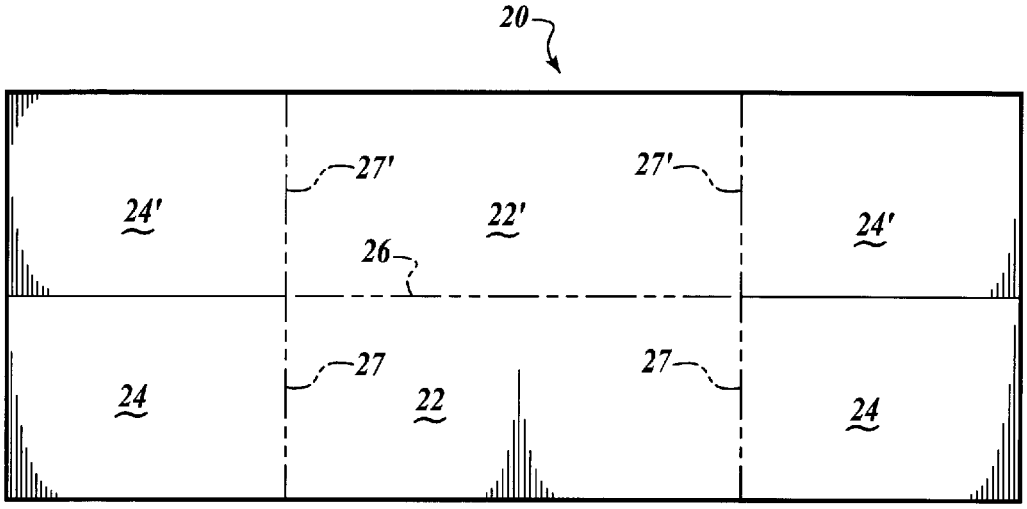
FIG. 2 is a plan view of a single piece H-divider blank formed in accordance with the present invention.

With reference to FIG. 2, an additional aspect of the present invention is disclosed. More specifically, an H-divider 20 is disclosed. The H-divider 20 is formed from a single piece of formable material, such as, without limitation, paperboard or containerboard material. The H-divider 20 is a symmetric, trifurcated panel with three substantially identical rectangular panels about a centrally located H-divider hinge line 26. A pair of transverse panels 22, 22' define a central portion of the H-divider 20. Disposed on opposing sides of the transverse panels 22, 22' are side wing panels 24, 24'. The transverse panels 22, 22' are hingedly connected to one another via centerline 26. Additionally, the transverse panels 22, 22' are hingedly coupled to side wing panels 24, 24' along hinge lines 27. When inserted into the container 40, the H-divider hinge line 26 is substantially parallel to and substantially adjacent the container's detachable hinge line 18. In this manner, separation of the first and second display units 3,5 also separates the H-divider 20 wherein a substantially identical portion of the H-divider 20 remains with each display unit 3,5.

Figure 3:
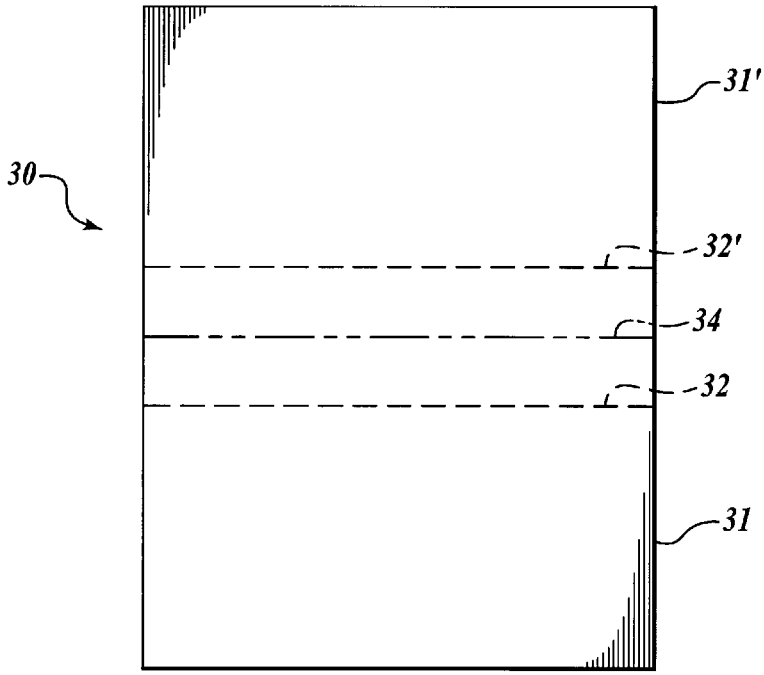
FIG. 3 is a plan view of a single piece closure panel blank formed in accordance with the present invention

FIG. 3 illustrates an aspect of an additional embodiment of the present invention. More specifically, a closure panel 30 is disclosed. The closure panel 30 is configured to substantially cover the open face of the container 40. Like the H-divider 20, the closure panel 30 is preferably constructed from a formable material, such as, without limitation, paperboard. However, other materials may be used to produce the closure panel 30 without departing from the spirit and scope of the present invention. By way of non-limiting example, a containerboard or singleface material may be used for the closure panel 30 material. Alternatively, the closure panel 30 may be omitted or replace with another closure material, such as, without limitation, a shrink-wrap material.

The closure panel 30 is generally rectangular in shape and is divided into two substantially equal display unit cover sections 31, 31' by a medial hinge line 34. A pair of score lines 32 are spaced substantially equidistant from the medial hinge line 34. As will be appreciated, the medial hinge line 34 and the score lines 32 are hinge regions, which allow the closure panel 30 to displace along the lines during separation of the container 40. It will be appreciated, that if a single face material is used for the closure panel 30, the medial hinge lines 34 and score line 32 may be unnecessary and thus excluded.

Figure 4:
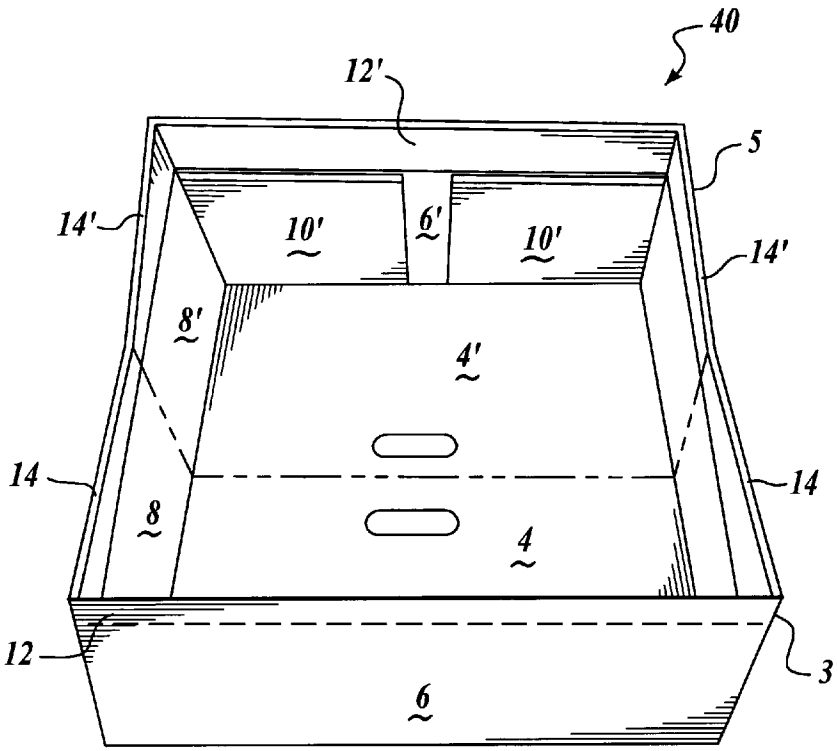
FIG. 4 is a perspective view of a container formed in accordance with the present invention.

FIG. 4 illustrates the blank 2 after the various panels and flaps have been moved out of a single plane. More specifically, the FIGURES depict various aspects of the erection of the blank 2 into the container 40 of the present invention.

It will be appreciated that assembly of container 40 is preferably initiated by folding side panels 8, 8' along hinge line 9 and 9', respectively, approximately 90 degrees relative to the plane formed by bottom panels 4, 4'. Side flaps 10, 10' may then be similarly folded along hinge lines 29, and 29', respectively. Subsequently, end panels 6, 6' are folded along hinge lines 11, 11' approximately 90 degrees relative to the plane formed by bottom panels 4,4'.

Side flaps 10, 10' are fastened to end panels 6, 6'. In a presently preferred embodiment, a glue is used to fasten the various panels and flaps. However, it will be appreciated that any fastener is considered within the scope of the present invention, such as, without limitation, brads, tacks, staples, clips, adhesives of any kind, or combinations thereof.

Figure 5:
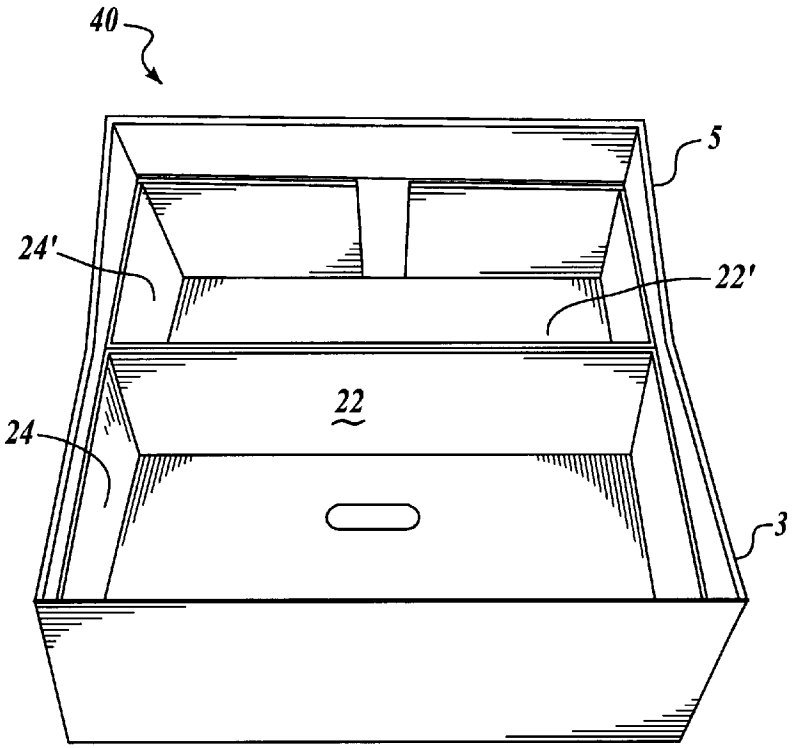
FIG. 5 is a perspective view of an aspect of the present invention.

FIG. 5 depicts a presently preferred embodiment of the container 40. More specifically, the container 40 is shown using the H-divider 20 to separate the single internal volume into distinct display units 3, 5, each defining a separate volume. Conversely, as depicted in FIG. 4, the container may be used without the H-divider 20. The removable aspect of the H-divider 20 is more fully discussed below.

Figure 6:
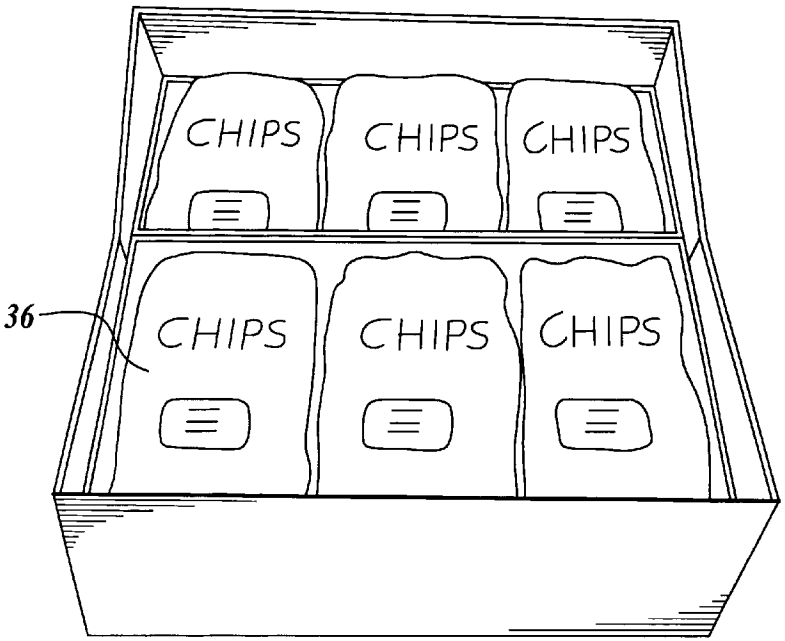
FIG. 6 is a perspective view of another aspect of the present invention.

Referring now to FIG. 6 the container 40 is shown filled with a product. It will be appreciated, the present invention may be used to pack, store, or display any variety of product 36. The product 36 may be in boxes, bags, or other individual packaging.

Figure 7:
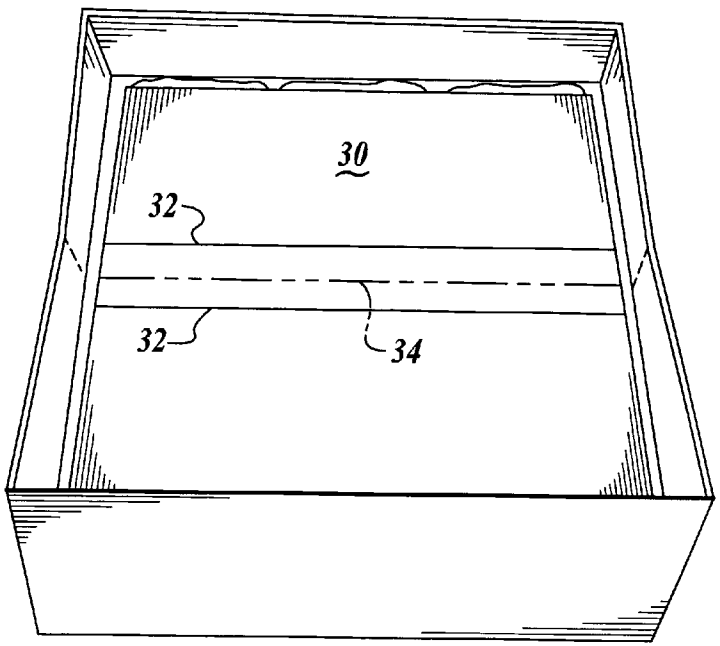
FIG. 7 is a perspective view of an embodiment of the present invention.
Figure 8:
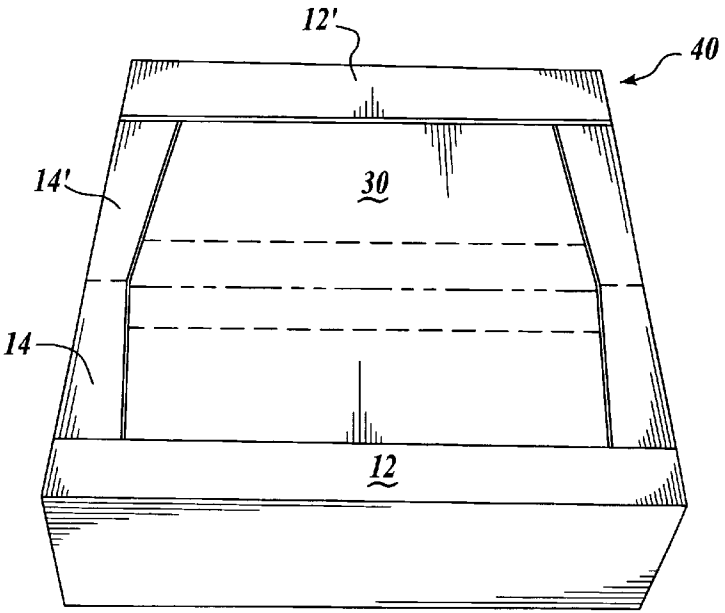
FIG. 8 is a perspective view of an assembled view of an embodiment of the present invention.

FIGS. 7 and 8 illustrate a presently preferred use of the closure panel 30. The top closure panel 30 is inserted to cover the contained product 36. The upper side flaps 14, 14' are folded in and end flaps 12, 12' are folded down and fastened to the side flaps 14, 14' at 40—where the end flaps 12, 12' overlap the side flaps 14, 14'. It will be appreciated, that when a shrink-wrap or similar material is used in lieu of the closure panel 30 the entire container 40 is encapsulated.

Figure 9:
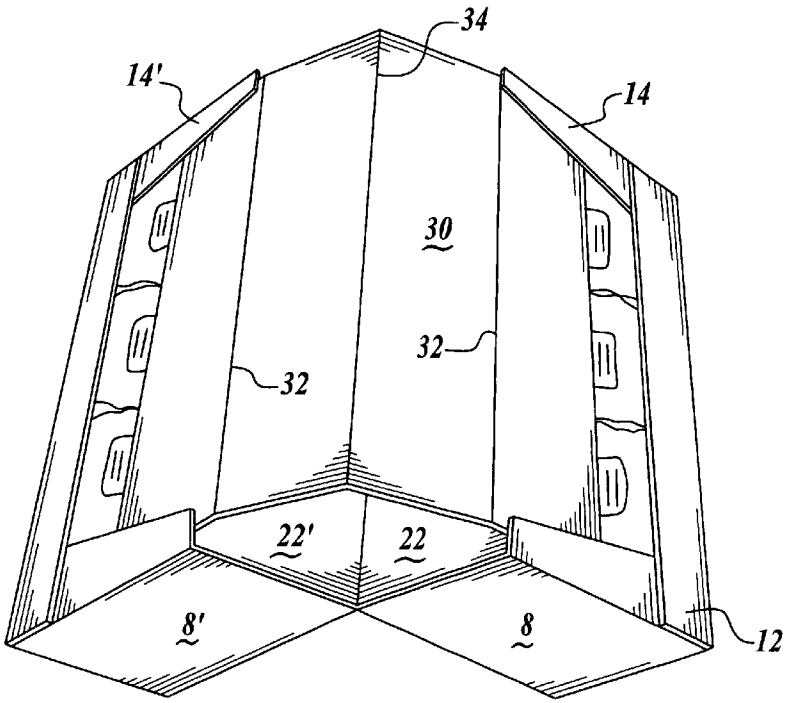
FIG. 9 is a perspective view of another embodiment of the present invention.
Figure 11:
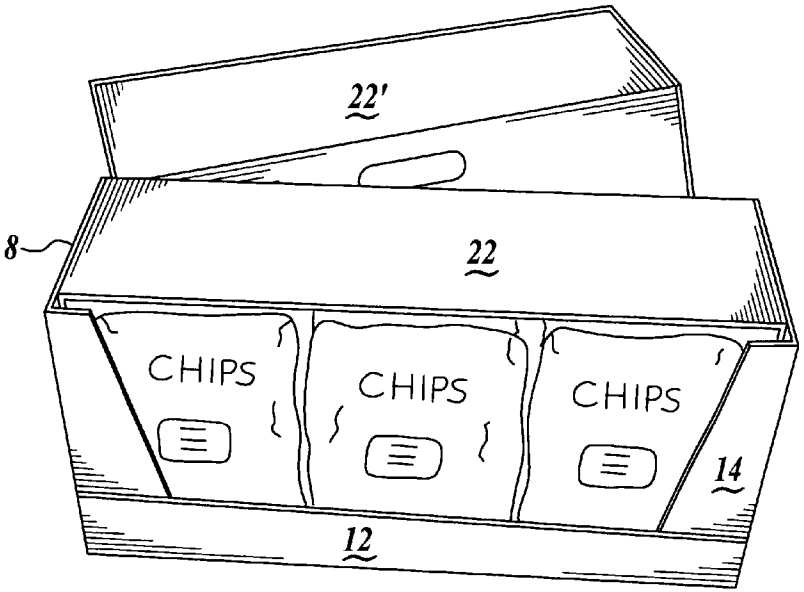
FIG. 11 is a perspective view of a further embodiment of the present invention.
Figure 10:
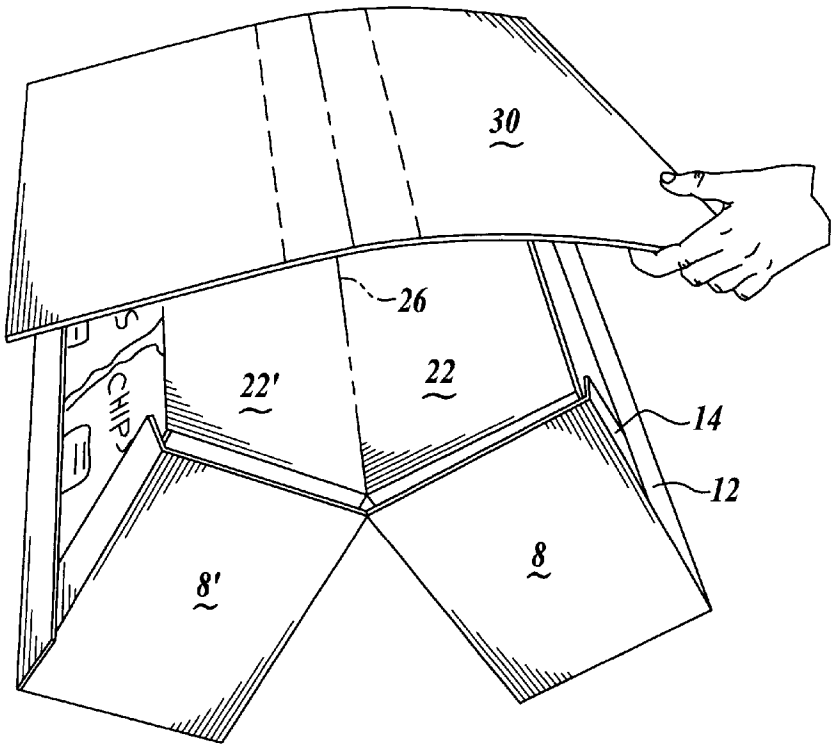
FIG. 10 is a perspective view of yet another embodiment of the present invention.

FIGS. 9–11 depict the separable nature of the container 40. Initially, the closure panel 30, if used, is removed. This may be accomplished by displacing the container 40 along detachable hinge line 18, which will cause the closure panel 30 to likewise displace and fold along score lines 32 and perforation line 34. The closure panel 30 may then be easily removed by sliding it out from under side flaps 14, 14'.

The container 40 may be used in several different display configurations. As discussed above, the container may be used in a planar arrangement as depicted in FIG. 4 in either a vertical or horizontal orientation. Further, the container 40 may be folded about the detachable hinge line 18 until the first and second display units 3, 5 are in a back to back arrangement. The first and second display units 3, 5 may be left connected to one another at the detachable hinge line 18 or they may be separated into individual display units (FIG. 11). When separated, the first and second display units 3, 5 may alternatively be stacked vertically, placed side-by-side or employed individually.

Figure 13:
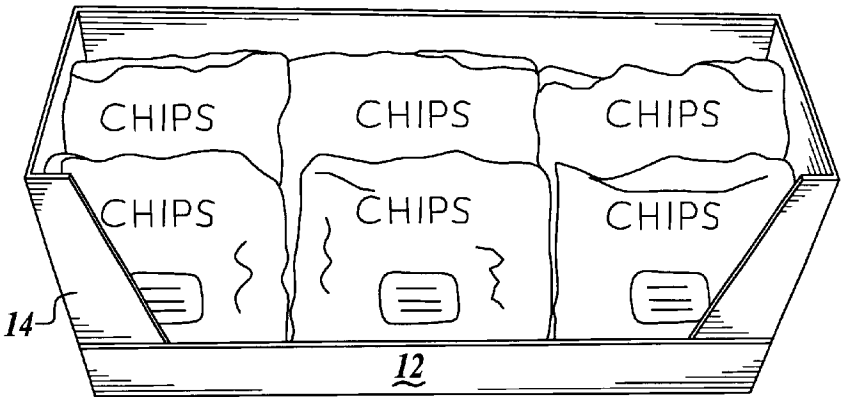
FIG. 13 is a perspective view of a further embodiment of the present invention.
Figure 12:
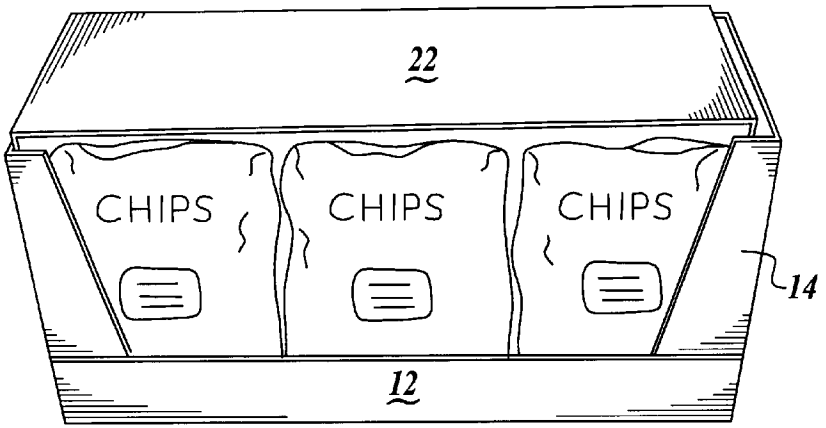
FIG. 12 is a perspective view of one embodiment of the present invention.

FIGS. 12 and 13 depict an additional aspect of the present invention. More specifically, the FIGURES more fully illustrate the removable nature of the H-divider 20 and resulting alternative display unit 3,5, configurations. FIG. 12 illustrates the first display unit 3 with the H-divider 20. Conversely, FIG. 13 depicts the first display unit with the H-divider 20 removed. In the former, the H-divider 20 provides additional strength or a stacking base. In the latter, a greater overall access area is provided for the removal of the product 36.

As will be appreciated from reading the above, the present invention avoids many of the problems or limitations of prior containers. The present invention is easy to set up and handle, and includes elements, which may be secured together with a minimum effort. The present invention may be used as packaging, shipping and/or displaying a product at a point of sale. Additionally, the present invention allows great flexibility to the retailer in regards to displaying the product. As noted before, the container may be used as a single element displaying products either horizontally or vertically. Further, the display units may be folded in half about the detachable hinge line wherein the display units are configured to display the products back-to-back in a back to back fashion. Finally, the display units may be completely separated from one another and packed, shipped or displayed in isolation, a side-to-side, one-over-the-other arrangement, or stacked several units high.

While the preferred embodiment of the invention has been illustrated and described, as noted above, many changes can be made without departing from the spirit and scope of the invention. Accordingly, the scope of he invention is not limited by the disclosure of the preferred embodiment. Instead, the invention should be determined entirely by reference to the claims that follow.

What is claimed is:

1. A multipurpose container comprising:

a pair of display units attached along a detachable hinge line, each of said display units having a bottom panel, opposed side panels, an end panel, a beveled side flap attached to each side panel, and an upper flap attached to said end panel; and, a removable H-divider detachable along an H-divider hinge line disposed within said container, said container being configured to divide the pair of display units substantially along the detachable hinge line, the H-divider being configured such that the H-divider hinge line is substantially parallel to and substantially adjacent the detachable hinge line.

2. The container of claim 1, further comprising hand-hold cutouts defined through each bottom panel.

3. The container of claim 2, wherein the cutouts are located substantially equidistant from the detachable hinge line.

4. The container of claim 1, wherein the container is constructed from at least one of a corrugated board and paperboard material.

5. The container of claim 1, further comprising a removable closure panel, the closure panel configured to substantially cover display units.

6. The container of claim 5, wherein the closure panel is constructed from at least one of a paperboard, containerboard and singleface material.

7. A blank of formable material cut and scored to form a container substantially symmetrical about a detachable hinge line, the blank comprising:

a first display unit having a bottom panel with opposing side panels, each side panel having a beveled side flap and an end panel having an upper flap;

a second display unit, the second unit being substantially similar to the first displays unit, the second having a bottom panel with opposing side panels, each side panel having a beveled side flap and an end panel having an upper flap; and a pair of hand-hold cutouts defined through each bottom panel.

8. The blank of claim 7, wherein the cutouts are substantially equidistant from the detachable hinge line.

9. The blank of claim 7, wherein the blank is constructed from at least one of a containerboard and paperboard material.

10. The blank of claim 7, wherein the side panels further comprise end flaps hingedly attached opposite the detachable hinge line.

11. The blank of claim 7, wherein the beveled side flaps are configured such that the taper of the bevel is toward the detachable hinge line.

* * * * *